US006044587A

United States Patent [19]

Vetter et al.

[11] Patent Number: 6,044,587

[45] Date of Patent: Apr. 4, 2000

[54] SCISSORS-TYPE WINDOW OPERATOR

[75] Inventors: Gregory J. Vetter; Stephen M. Piltingsrud, both of Owatonna, Minn.

[73] Assignee: Truth Hardware Corporation, Owatonna, Minn.

[21] Appl. No.: 08/814,084

[22] Filed: Mar. 10, 1997

[51] Int. Cl.[7] ..... E05D 15/10

[52] U.S. Cl. ..... 49/324; 49/345; 49/346

[58] Field of Search ..... 49/339, 340, 341, 49/342, 345, 346, 333, 334, 335, 324

[56] References Cited

U.S. PATENT DOCUMENTS

| | | | |
|---|---|---|---|
| 2,185,321 | 1/1940 | Thoma . | |
| 2,674,452 | 4/1954 | Hummert . | |
| 2,824,735 | 2/1958 | Stavenau et al. . | |
| 2,961,234 | 11/1960 | Munro | 49/346 |
| 2,977,810 | 4/1961 | Stavenau | 49/345 X |
| 3,032,330 | 5/1962 | Stavenau . | |
| 3,044,311 | 7/1962 | Gagnon . | |
| 3,098,647 | 7/1963 | Teggelaar et al. . | |
| 3,114,542 | 12/1963 | Ahlgren | 49/346 X |
| 3,139,276 | 6/1964 | Hay | 49/346 X |
| 3,214,157 | 10/1965 | Stavenau | 49/346 X |
| 3,258,874 | 7/1966 | Martin | 49/346 X |
| 3,422,575 | 1/1969 | Armstrong . | |
| 3,457,675 | 7/1969 | Armstrong | 49/346 X |
| 3,461,609 | 8/1969 | Armstrong . | |
| 3,508,362 | 4/1970 | Wright | 49/341 |
| 3,523,389 | 8/1970 | Gray . | |
| 4,068,408 | 1/1978 | Hauber . | |
| 4,136,578 | 1/1979 | Van Klompenburg | 49/345 X |
| 4,143,556 | 3/1979 | Hauber . | |
| 4,241,541 | 12/1980 | Van Klompenburg et al. . | |
| 4,253,276 | 3/1981 | Peterson et al. . | |
| 4,266,371 | 5/1981 | Erdman et al. . | |
| 4,617,758 | 10/1986 | Vetter . | |
| 4,823,508 | 4/1989 | Allen . | |
| 4,938,086 | 7/1990 | Nolte et al. | 49/341 X |
| 5,272,837 | 12/1993 | Nolte et al. . | |
| 5,535,551 | 7/1996 | Falk et al. | 49/140 X |

FOREIGN PATENT DOCUMENTS

| | | |
|---|---|---|
| 595250 | 3/1960 | Canada . |
| 889194 | 12/1971 | Canada . |

*Primary Examiner*—Jerry Redman

*Attorney, Agent, or Firm*—Wood, Phillips, VanSanten, Clark & Mortimer

[57] ABSTRACT

An operator for controlling the movement of a window sash generally pivotable relative to a frame about a first edge between open and closed positions includes a first arm having a first end slidably attachable to a second edge of the window sash opposite the sash first edge. A second arm has a first end also slidably attachable to the sash second edge, and is further pivotally secured to the first arm. A base is attached to a frame and includes a drive attached to the other ends of the first and second arms for pivoting the first arm relative to the second arm whereby the first ends and second ends of first and second arms are disposed together with a window sash in an open position and the first ends and second ends are spaced apart with a window sash in a closed position. A connector for slidably attaching an operator arm to a window sash includes a metal track attachable to a window sash, a plastic shoe translatable along the track, and a plastic post pivotally secured to the shoe by a metal rod substantially parallel to the track. The post is disposable through an opening in the operator arm so that an end of the post protrudes from the opening. A plastic clip is disposed about the end of the post for securing the post in the operator arm opening.

28 Claims, 8 Drawing Sheets

SCISSORS-TYPE WINDOW OPERATOR

CROSS-REFERENCE TO RELATED APPLICATIONS

Not Applicable.

STATEMENT REGARDING FEDERALLY SPONSORED RESEARCH/DEVELOPMENT

Not Applicable.

BACKGROUND OF THE INVENTION

1. Technical Field

The present invention is directed to a window operator, and more particularly toward an operator for controlling the position of an awning window.

2. Background Art

Window operators are commonly used to move a window sash relative to a window frame between open and closed positions. Window operators known in the art include a base attachable to the window frame and one or more primary arms pivotally mounted about an axis or axes to the base and attachable to the window sash, which itself is pivotally mounted to the window frame. The window operator also includes a suitable drive system for pivoting the primary arm or arms about the axis or axes, and thereby moving the sash relative to the frame between the open and closed positions.

In some window operators known in the art, the primary arm is directly connected to the drive system and the window sash. See, for example, U.S. Pat. Nos. 4,617,758; 4,241,541; 4,143,556; 4,068,408; 3,461,609; 3,044,311; 3,032,330; and 2,674,452; and Canadian Patent Nos. 889, 194 and 595,250. Typically, in these window operators, one end of the primary arm is connected to a gear which meshes with the gear or gears of the drive system to pivot the primary arm in response to an input from the drive system. The other end of the primary arm may then be connected the window through a connector which slides along a track attached to the window sash. See, for example, U.S. Pat. Nos. 4,068,408 and 3,044,311. Alternatively, the other end of the primary arm may be fixedly but pivotally attached to the window sash. See, for example, U.S. Pat. No. 4,617,758.

In other window operators known in the art, the primary arm is directly connected to the drive system, but indirectly connected to the window sash through a linkage system. See, for example, U.S. Pat. Nos. 5,272,837; 4,823,508; 4,266,371; 4,253,276; 4,241,541; 3,523,389; 3,422,575; 3,098,647; 2,824,735; and 2,185,321 and Canadian Patent No. 889,194. Typically, in these window operators, one end of the primary arm driveably engages the drive system, and the other end is connected to one or more secondary arms. Typically, a single secondary arm is attached to the primary arm, the secondary arm being fixedly but pivotally attached to the window sash. See, for example, U.S. Pat. No. 5,272, 837.

While capable of moving the window sash relative to the window frame significant distances, the window operators discussed above may be bulky and difficult to install. In particular, to have the sash positioned the desired distance from the frame in the open position, the primary arms and secondary arms have generally been required to be so large that they extend a considerable distance laterally from the base with the sash in the closed position. Such lateral extension of the arms from the base can make the window operator difficult to install. The lateral extension of the arms also limits the size of windows with which such operators may be used. For example, narrow windows might require use of operators which will not provide as great an opening distance as might otherwise be desired Furthermore, in those window operators in which the arm is slidably attached to the window sash, the arm, the connector, and the connector clip (such as is shown in U.S. Pat. No. 3,461,609, for example) can be noisy and prone to corrosion.

The present invention is directed toward overcoming one or more of the problems discussed above.

BRIEF SUMMARY OF THE INVENTION

According to an aspect of the present invention, an operator for controlling the movement of a window sash pivotable relative to a frame about a first edge between open and closed positions includes a first arm having a first end slidably attachable to a second edge of a window sash opposite a first edge of the window sash about which the window sash is pivotable relative to a frame. A second arm has a first end slidably attachable to a second edge of a window sash opposite a first edge of the window sash about which the window sash is pivotable relative to a frame, and is pivotally secured to the first arm. A base is attached to a frame and a mechanism is attached to the base and to second ends of the first and second arms for pivoting the first arm relative to the second arm such that the first ends and second ends of the first and second arms are disposed together with a window sash in an open position and the first ends and second ends are spaced apart with a window sash in a closed position.

According to a further aspect of the present invention, an operator for controlling the movement of a window sash pivotable relative to a frame about a first edge between open and closed positions includes a first arm pivotable about a first axis and a second arm pivotally mounted to the first arm about a second axis. A third arm is also pivotally attached to the first arm, and is translatably attachable to a second edge of a window sash opposite a first edge about which the window sash pivots relative to a frame. A fourth arm is pivotally attached to the second arm and the third arm, and is also translatably attachable to a second edge of a window sash opposite a first edge about which the window sash pivots relative to a frame. A mechanism drives the second arm about the second axis and the first arm about the first axis to move a window sash between open and closed positions.

According to an additional aspect of the present invention, an operator for controlling the movement of a window sash pivotable relative to a frame about a first edge between open and closed positions includes a sun gear pivotable about an axis. A drive gear driveably engages the sun gear. A first arm pivots about the axis, and a second arm is pivotally attached to the first arm and driveably engages the sun gear. A third arm is pivotally attached to the first arm and slidably attachable to a second edge of a window sash opposite a first edge about which the window sash pivots relative to a frame. A fourth arm is pivotally attached to the second arm and the third arm and slidably attachable to a second edge of a window sash opposite a first edge about which the window sash pivots relative to a frame.

According to a still further aspect of the present invention, a connector assembly for slidably attaching an arm of a window operator to a window sash includes a metal track attachable to a window sash, a plastic shoe is translatable along the track, and a plastic post pivotally attached to the shoe about an axis substantially parallel to the track. The post is disposable through an opening in an arm of a window operator such that an end of the post protrudes from the opening, and a mechanism is disposable about the end of the post for securing an arm of a window operator to the connector.

According to a further aspect of the present invention, an operator for controlling the movement of a window sash relative to a frame, the window sash being pivotable relative to an axis, includes a drive mechanism securable to a window frame, the mechanism controllably moving a first drive arm having an opening at one end thereof. The operator further includes a metal track attachable to a window sash, a plastic shoe translatable along the track, and a plastic post pivotally attached to the shoe about an axis substantially parallel to the track. The post is disposable through the arm opening with an end of the post protruding from the opening. A mechanism is disposable about the end of the post for securing the operator first drive arm to the post It is an object of the present invention to provide a window operator which may be used in existing installations.

It is another object of the invention to provide a window operator which is inexpensive to manufacture and install.

It is still another object of the invention to provide a window operator which will operate reliably over a long useful life.

It is yet another object of the invention to provide a window operator which is highly resistant to corrosion in all environments.

Another object of the present invention is to provide a window operator which may be readily used with a wide variety of installations, including a wide range of sizes of windows.

Still another object of the present invention is to provide a window operator which may be used to minimize inventory costs, handling costs, and design and installation errors.

Yet another object of the present invention is to provide a window operator having only a minimal visual intrusion on the window aesthetics.

DETAILED DESCRIPTION OF THE INVENTION

Figure 1:
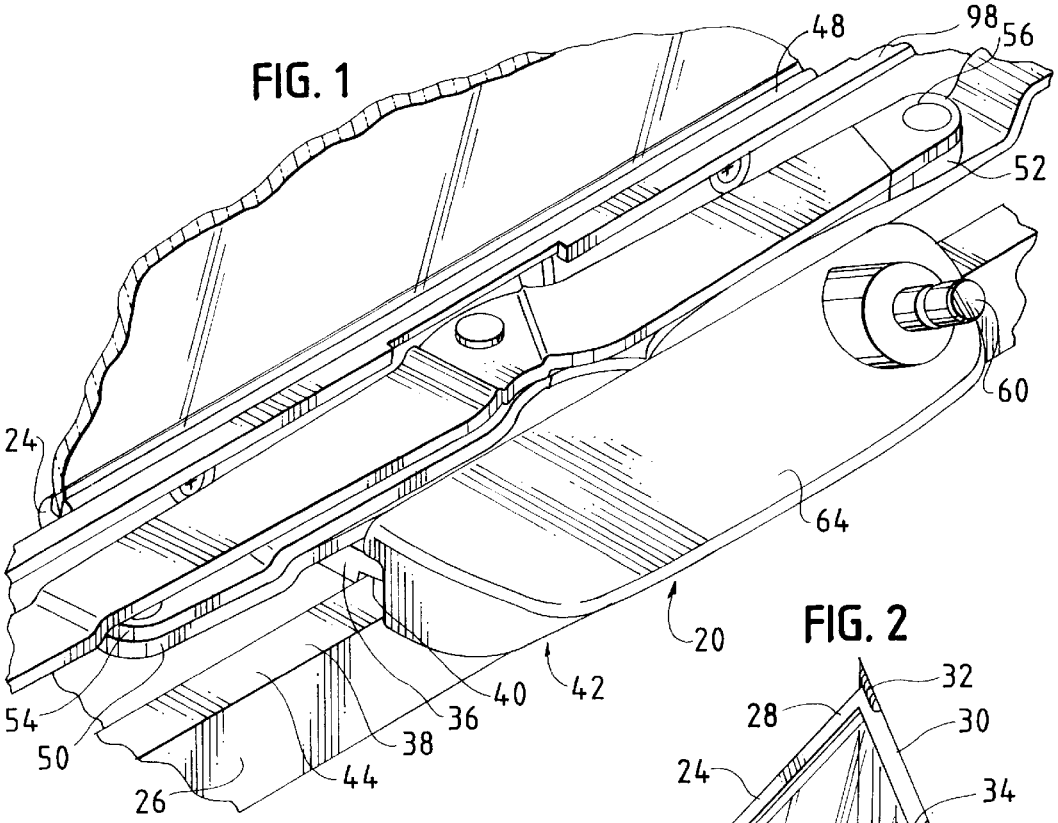
FIG. 1 is a broken partial view of an embodiment of a window operator according to the present invention installed to a window frame and attached to an awning window sash for moving the sash between open and closed positions relative to the frame, the window sash being in the closed position.

In an embodiment of the present invention, a scissors-type window operator 20 according to the present invention is installed in an awning-type window 22 including a sash 24 and a frame 26. The sash 24 is pivotally connected to the frame 26 about an upper edge 28 of the sash 24 and an upper edge 30 of the frame 26. Specifically, the sash 24 pivots about hinges 32, 34 which are connected to the sash 24 and the frame 26 at the upper edges 28, 30. Alternatively, as is well known, suitable hinges could be secured to opposite sides of the sash 24 and frame 26. With all such hinges, opening of the sash 24 generally involves pivoting of the sash 24 about one sash edge relative to the frame 26.

It should be understood that although the preferred form of the present invention is as used with an awning-type window, aspects of the present invention could also advantageously be used with other window types including, for example, casement windows and skylights.

The window operator 20 has a base 36 which is secured to a sill 38 of the frame 26. The base 36 has a slot 40 with a rectangular cross-section formed along an underside surface 42 of the base 36. A ridge 44 of rectangular cross-section extends from the sill 38, and mates with the slot 40 of the base 36. The ridge 44 and the slot 40 cooperate to prevent water and air from infiltrating along the interface between the base 36 and the sill 38, as is taught by commonly owned Anderson et al. in U.S. patent application Ser. No. 08/575,143, filed Dec. 19, 1995, the disclosure of which is hereby incorporated by reference.

A linkage system 46 attaches the window operator 20, and in particular the base 36, to a lower edge 48 of the window sash 24 opposite the upper edge 28. The linkage system 46 includes a first primary arm 50, a second primary arm 52, a first secondary arm 54 and a second secondary arm 56. The first primary arm 50 is pivotally secured to the base 36, while the second primary arm 52 and the first secondary arm 54 are pivotally connected to the first primary arm 50. The second secondary arm 56 is pivotally connected to the second primary arm 52 and the first secondary arm 54. The first and second secondary arms 54, 56 are then slidably attached to the lower edge 48 of the window sash 24 as explained in greater detail below.

A drive system 58 is also attached to the base 36. The drive system 58, such as a planetary gear train as shown, causes the first and second primary arms 50, 52 to move in response to the rotation of the worm shaft 60 attached to the worm 62. The worm shaft 60 is shown in FIG. 1 as extending from the cover 64 which limits access to the drive system 58. The cover 64 also prevents dirt and water from contaminating the drive system 58.

Figure 2:
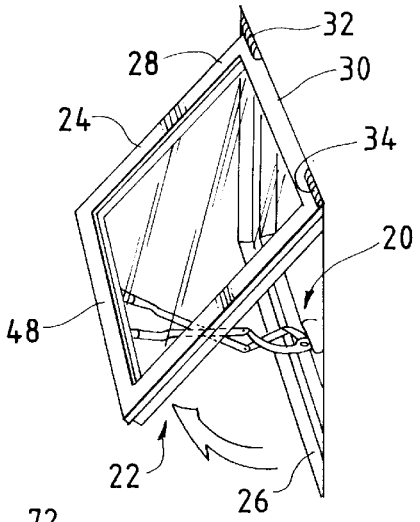
FIG. 2 is a perspective view of the window operator of FIG. 1 supporting an awning window sash in the open position.

To move the window sash 24 from the closed position (FIG. 1) to the open position (FIG. 2), the drive system 58 causes the ends 66, 68 of the primary arms 50, 52 to move spatially closer together. The movement of end 66 spatially toward end 68 causes the ends 70, 72 of the secondary arms 54, 56 to move closer together. As the secondary arms 54, 56 rotate about the pivot 74, the second ends 76, 78 of the secondary arms 54, 56 also move closer together.

The arms 50, 52, 54, 56 are bent at the ends 66, 68, 70, 72 such that the ends 66, 68, 70, 72 slope upward at an approximately equal angle to the horizontal. The slope of the ends 66, 68, 70, 72 allows the arms to follow the upward movement of the sash 24 as typically occurs, for example, with awning windows, in addition to the outward movement as ends 66, 68 and 70, 72 move closer together.

To close the sash 24, the steps of the general method described above for moving the sash 24 from the closed position to the open position are reversed, and the drive system 58 is used to move the ends 66, 68, 70, 72, 76 and 78 further apart. Particularly, as the ends 76 and 78, which are slidably attached to the lower edge 48 of the sash 24, move further apart, the ends 76, 78 draw the sash 24 downward and inward, rotating the sash 24 about the hinges 32, 34. To minimize the vertical dimension of the window operator 20 in the closed position as shown in FIG. 1, the arms 50, 52, 54, 56 are also bent to maintain a sufficient clearance between the arms 50, 52, 54 and 56.

Figure 3:
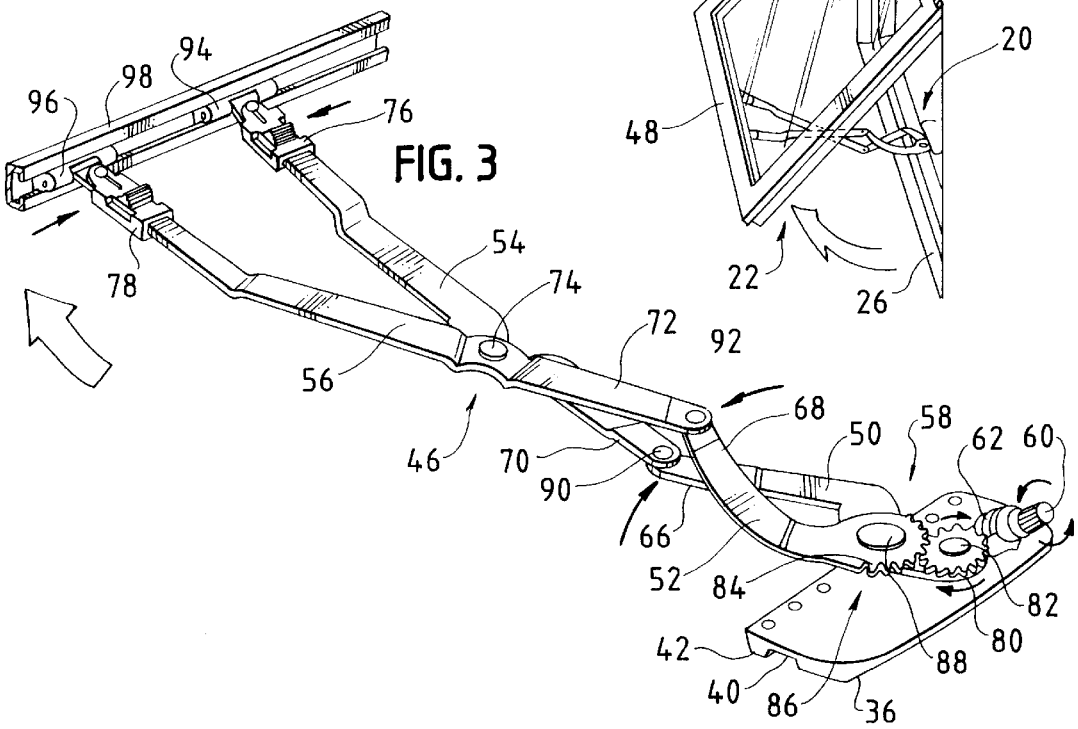
FIG. 3 is a perspective view of the window operator of FIG. 1 in an extended, open position.

Turning now to FIG. 3, the drive system 58 includes a planetary gear system with a sun gear 80. The sun gear 80 is pivotally attached about an axis 82 to the base 36, and is driveably engaged by the worm 62. The first primary arm 50 is also pivotally attached to the base 36 about the axis 82.

The drive system 58 also includes a planetary gear 84 secured to the end 86 of the second primary arm 52. As shown, the planetary gear 84 is formed integrally with the end 86 of the second primary arm 52. The second primary arm 52 is pivotally attached to the first primary arm 50 at an axis 88, about which the planetary gear 84 rotates.

The remainder of the linkage system 46 is connected to the primary arms 50, 52 which cooperate with the drive system 58 as follows. The first secondary arm 54 is pivotally attached to end 66 of the first primary arm 50 at an axis 90. The second secondary arm 56 is pivotally attached to end 68 of the second primary arm 52 at an axis 92. The first and second secondary arms 54, 56 are pivotally attached to each other at the pivot 74.

The linkage system 46, and in particular ends 76, 78 of secondary arms 54, 56, is slidably connected to the sash 24 through the use of a connector including sliders 94, 96. Sliders 94, 96 are disposed in a C-shaped track 98 which is secured to the lower edge 48 of the sash 24.

Figure 6:
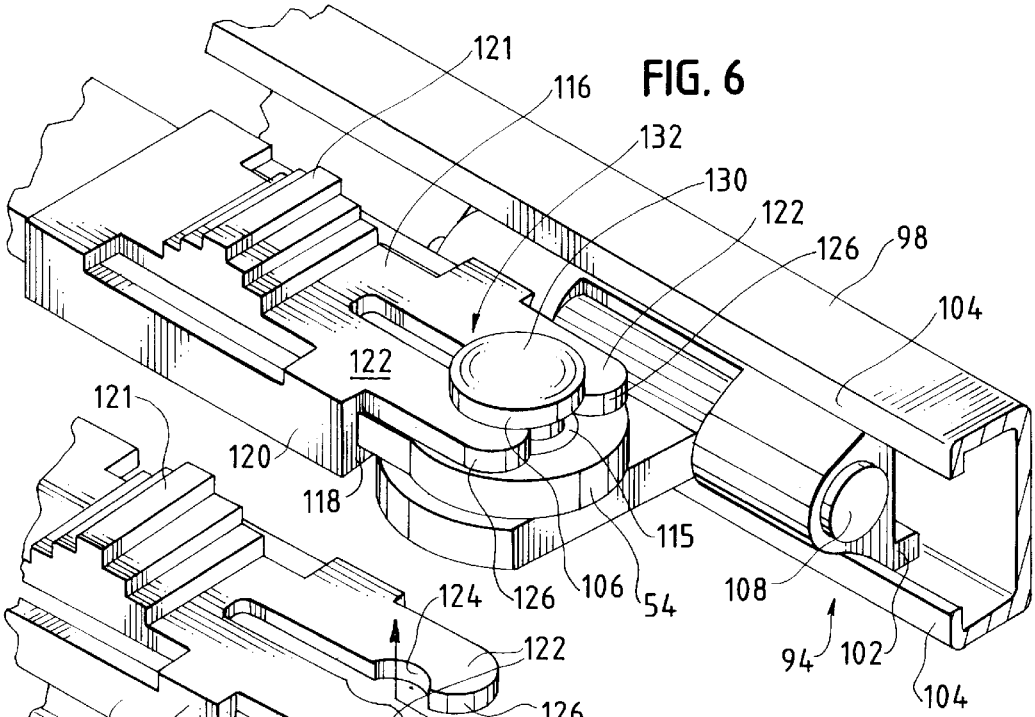
FIG. 6 is a perspective view of an embodiment of a connector for attaching an arm of a window operator to a window sash.
Figure 7:
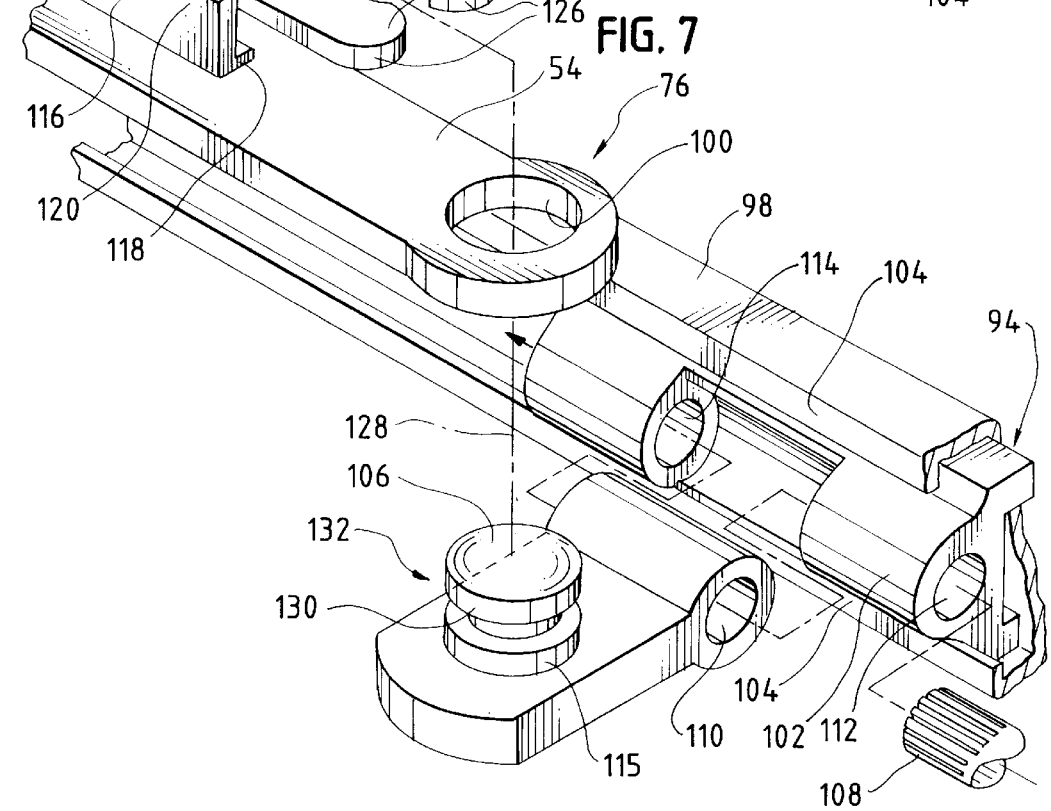
FIG. 7 is a perspective exploded view of the connector shown in FIG. 6.

Specifically, as best shown in FIGS. 6 and 7, the end 76 of the arm 54, for example, has a opening 100 formed therethrough. The slider 94 includes a shoe 102 which is slidable along the track 98 and maintained in the track 98 by the overhanging lips 104 formed integrally with the track 98. The slider 94 also includes a post 106 which is pivotally mounted to the shoe 102 by pin 108 which is disposed in a passage 110 in the post 106 and passages 112, 114 in the shoe 102.

The post 106 is disposed through the opening 100 in the end 76 of the arm 54. With the post 106 disposed through the opening 100, the internal surface of the opening 100 at least partially abuts a shoulder 115 formed at the proximal end of the post 106. The internal surface of the opening 100 and the shoulder 115 cooperate to limit undesirable relative lateral movement between the arm 54 and the post 106.

The post 106 is maintained in the opening 100 of the arm 54 through the use of a clip 116. The clip 116 is slidably mounted to the arm 54 through the cooperation of the arm 54 and tabs 118 inwardly depending from the downwardly extending arms 120 of the clip 116. The clip 116 preferably includes a thumb engageable portion 121 allowing for easy manual sliding of the clip 116 when desired as described below. The clip 116 also has arms 122 which extend axially outwardly from the clip 116, defining therebetween a recess 124.

To maintain the post 106 in the opening 100, the clip 116 is moved along the arm 54 until edges 126 of the arms 122 contact the post 106. Further application of force to the clip 116 axially in the direction of the post 106 causes the post 106 to force the arms 122 radially outwardly with respect to the axis 128 of the post 106. The arms 122 are disposed radially outward until the post 106 aligns with the recess 124 defined between the arms 122. With the post 106 aligned with the recess 124, the arms 122 elastically return to their original positions.

The post 106 is maintained within the recess 124 through the interaction of the arms 122 and a radially outwardly extending cap or head 130 at the axially outwardmost extending end 132 of the post 106. In particular, the cap 130 is larger than the clip recess 124 to prevent the post 106 from slipping axially out of engagement with the arms 122. In a preferred embodiment, the post 106 (including the cap 130) is only slightly smaller in diameter than the diameter of the arm opening 100 with a reduced diameter neck portion secured to the cap 130, where the clip arms 122 are disposed about the neck portion.

To limit corrosion to the ends 76, 78 of the arms 54, 56, it is advantageous to limit the amount of metal-to-metal contact between the clips a 116, the sliders 94, 96 and the track 98. Therefore, for example with reference to FIGS. 6 and 7, while the track 98, pin 108 and the arm 54 are made of a metallic material, the shoe 102, post 106, and clip 116 are made of a plastic material. With such a configuration, there is no metal to metal contact between components at this area and therefore corrosion is minimized.

Figure 8:
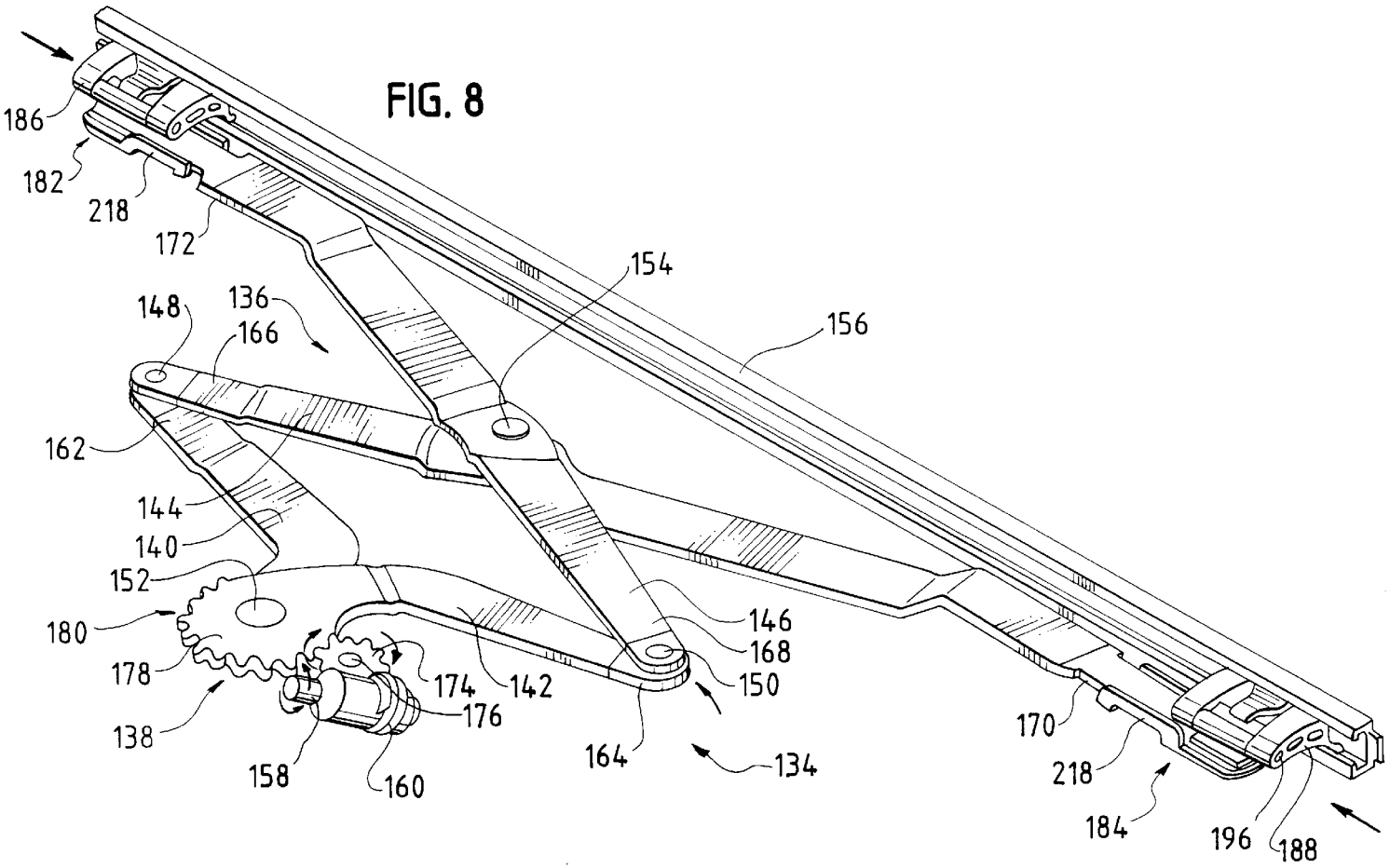
FIG. 8 is a perspective view of another embodiment of a window operator according to the present invention in an intermediate position between an extended, open position and a retracted, closed position.
Figure 9:
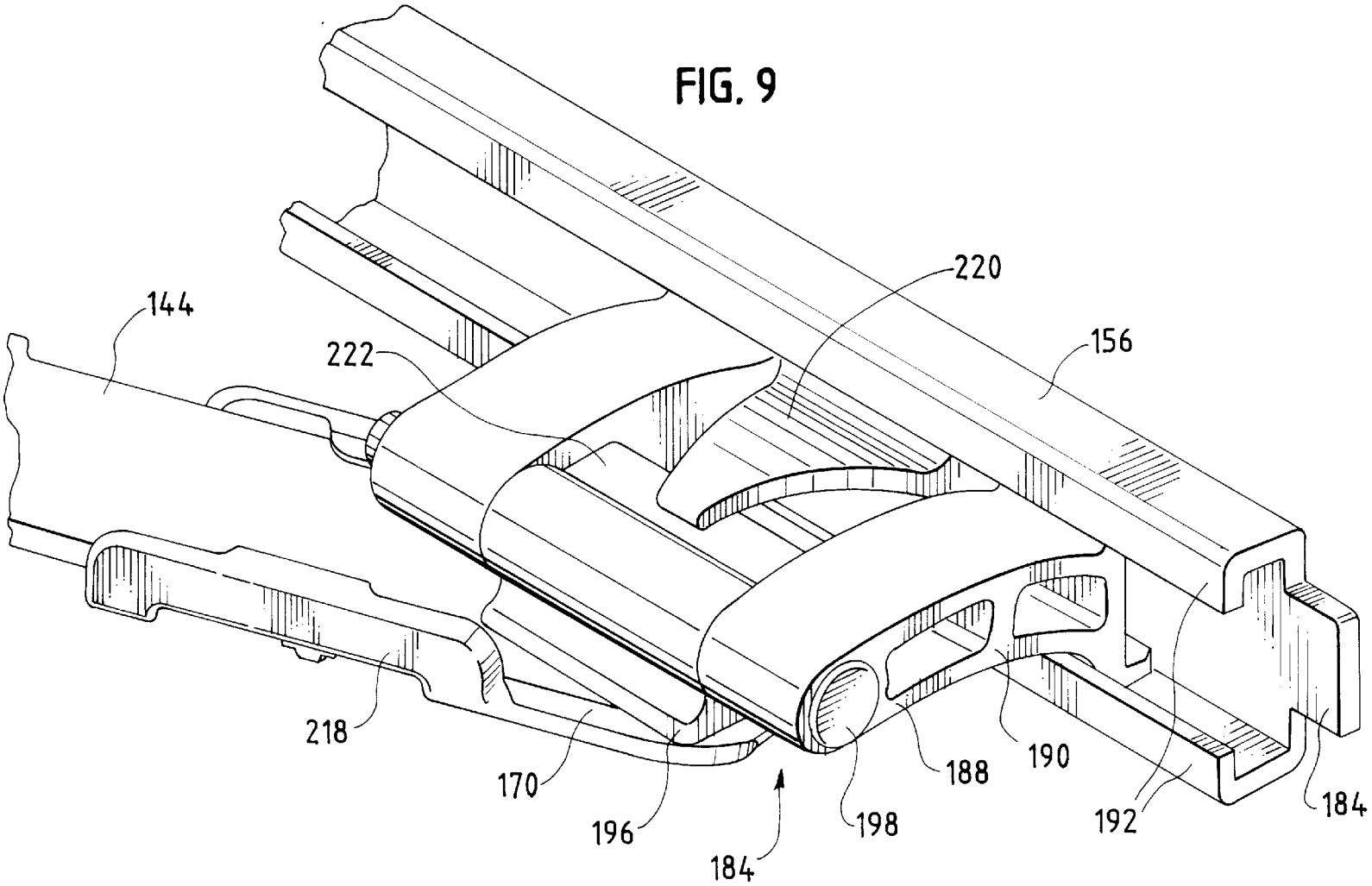
FIG. 9 is a perspective view of another embodiment of a connector for attaching an arm of a window operator to a window sash, the connector including a slider having a shoe and a post unit pivotally connected to the shoe.
Figure 10:
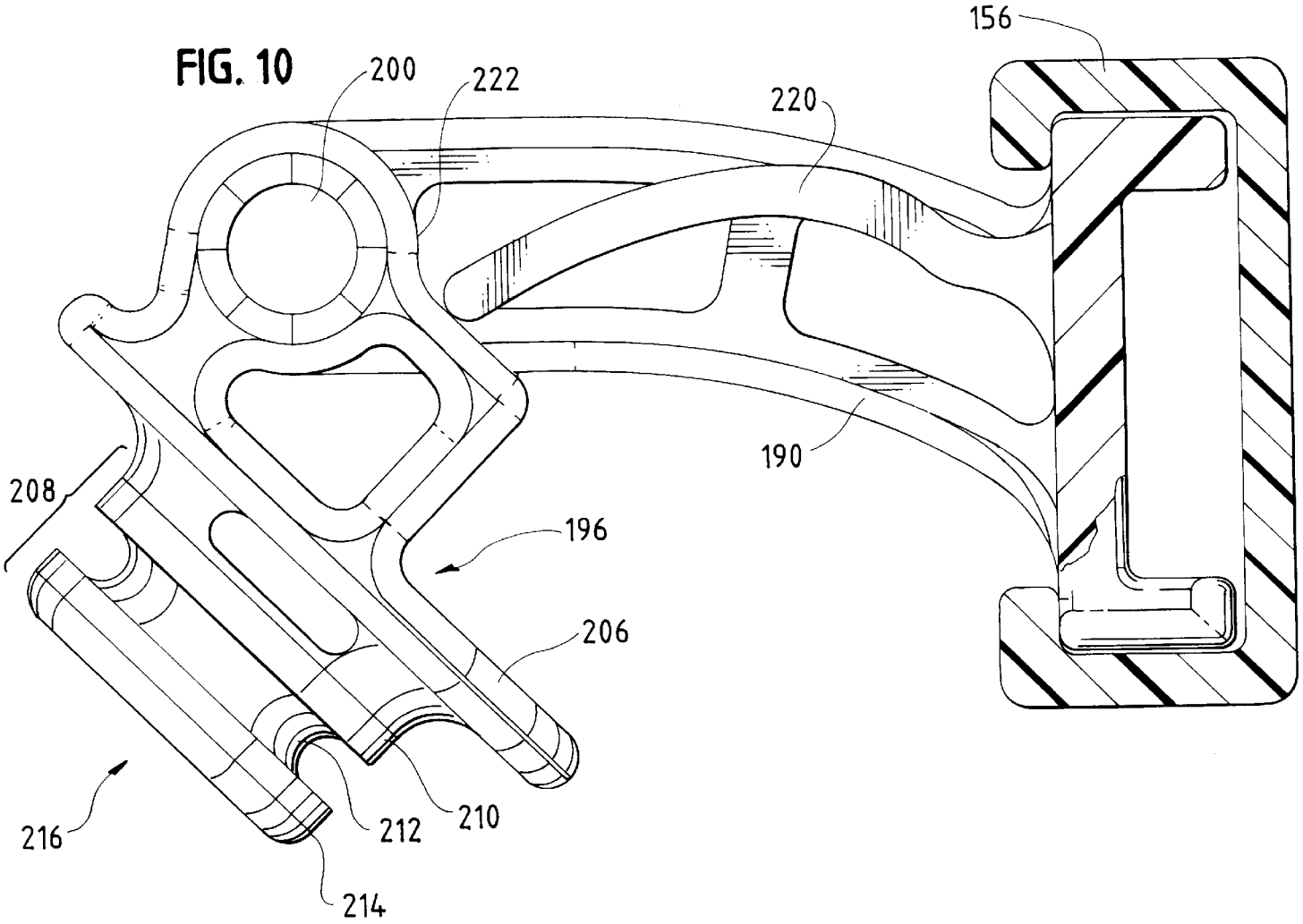
FIG. 10 is a cross-sectional view of the slider shown in FIG. 9.

In another embodiment of the present invention, a window operator 134 is shown in FIG. 8 in an intermediate position between an extended position and a retracted position. The window operator 134 includes a linkage system 136 and a drive system 138, similar in some respects to the linkage system 46 and drive system 58 previously discussed.

In particular, the linkage system 136 includes a first primary arm 140, a second primary arm 142, a first secondary arm 144, and a second secondary arm 146. The first primary arm 140 is connected to the first secondary arm 144 at a pivot 148, and the second primary arm 142 is connected to the second secondary arm 146 at a pivot 150. The first and second primary arms 140, 142 are connected at a pivot 152, while the first and second secondary arms 144, 146 are connected at a pivot 154. The first and second secondary arms 144, 146 are also slidably connected to a track 156 as explained in greater detail below. The track 156 may be attached, for example, to the lower edge of a window sash (not shown) in the manner described above with respect to the window operator 20.

The drive system 138, such as a planetary gear train as shown, causes the first and second primary arms 140, 142 to move in response to the rotation of a worm shaft 158 attached to a worm 160. For example, to move the window operator 134 from the intermediate position shown in FIG. 8 to an extended position, similar to that shown in FIG. 3, the drive system 138 causes ends 162, 164 of the primary arms 140, 142 to move spatially closer together. The movement of end 162 spatially toward end 164 causes ends 166, 168 of the secondary arms 144, 146 to move closer together. As the secondary arms 144, 146 rotate about the pivot 154, the second ends 170, 172 of the secondary arms 144, 146 also move closer together.

The arms 140, 142, 144, 146 are bent at the ends 162, 164, 166, 168 such that the ends 162, 164, 166, 168 slope upwardly at an approximately equal angle to the horizontal. The slope of the ends 162, 164, 166, 168 allows the arms 140, 142, 144, 146 to follow the upward movement of the track 156 as typically occurs, for example, when the track 156 is attached to a sash of an awning-type window, in addition to the outward movement as ends 162, 164 and 166, 168 move closer together.

Figure 4:
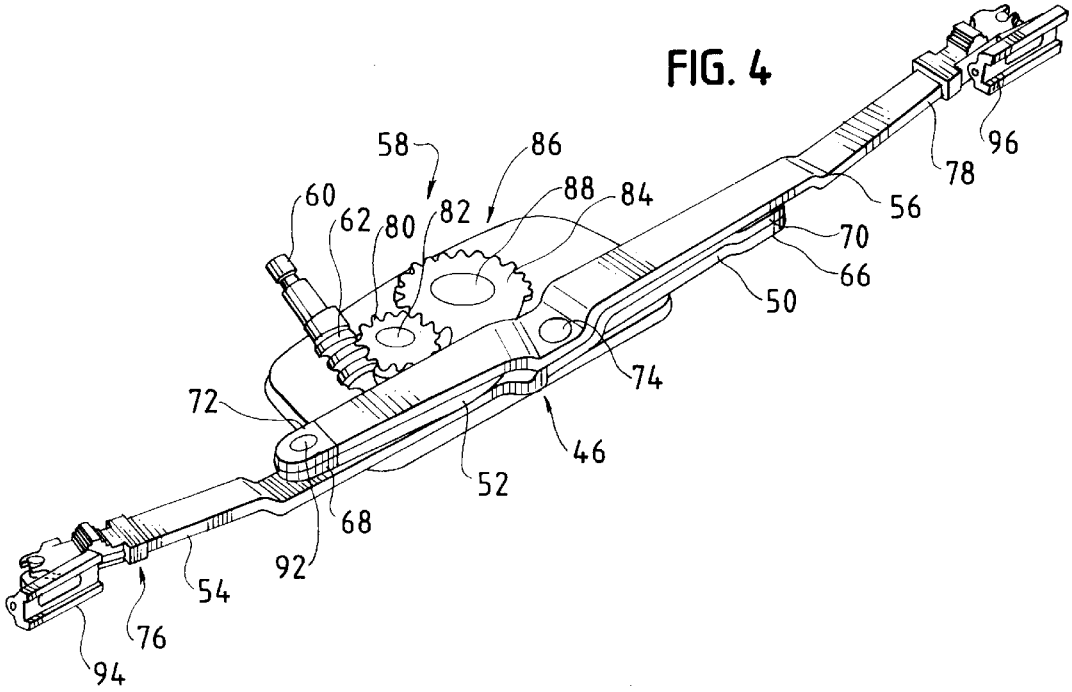
FIG. 4 is a perspective view of the window operator of FIG. 1 in a retracted, closed position.
Figure 5:
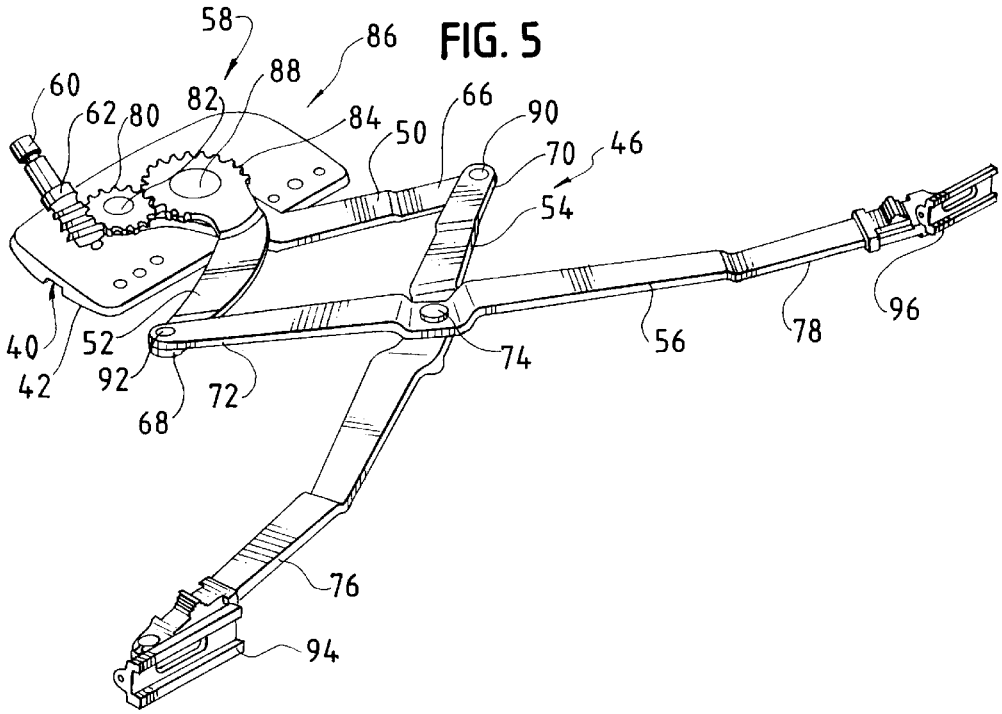
FIG. 5 is a perspective view of the window operator of FIG. 1 in an intermediate position between the extended and retracted positions.

To move from the intermediate position shown in FIG. 8 and a retracted position, such as is shown in FIG. 4, the steps of the general method described above for moving from the intermediate position to the extended position are reversed, and the drive system 138 is used to move the ends 162, 164, 166, 168, 170 and 172 further apart. Particularly, as the ends 170 and 172, which are slidably attached to the track 156, move further apart, the ends 170, 172 draw the track 156 downward and inward. To minimize the vertical dimension of the window operator 134 in the closed position, the arms 140, 142, 144, 146 are also bent to maintain a sufficient clearance between the arms 140, 142, 144, 146.

The drive system 138 includes a planetary gear system with a sun gear 174. The sun gear 174 is pivotally attached about an axis 176, and is driveably engaged by the worm 160. The first primary arm 140 is also pivotally attached about the axis 176.

The drive system 138 also includes a planetary gear 178 secured to the end 180 of the second primary arm 142. As shown, the planetary gear 178 is formed integrally with the end 180 of the second primary arm 142. As mentioned previously, the second primary arm 142 is pivotally attached to the first primary arm 140 at the axis 152, about which the planetary gear 178 rotates.

The drive system 138 may be enclosed between a base and cover (not shown) to limit access to the drive system 138 and to prevent the contamination of the drive system 138 by water and dirt, for example.

As mentioned previously, the ends 170, 172 of secondary arms 144, 146 are slidably connected to the track 156. The slidable connection to the track 156 is made through the use of connectors 182, 184 including sliders 186, 188.

FIGS. 9–12 show the connector 184 and, in particular, the slider 188 in greater detail for purposes of illustration.

The slider 188 includes a shoe 190 being slidable along the track 156. The shoe 190 is maintained in the track 156 by overhanging lips 192 and an end tab 194 formed integrally with the track 156.

Figure 11:
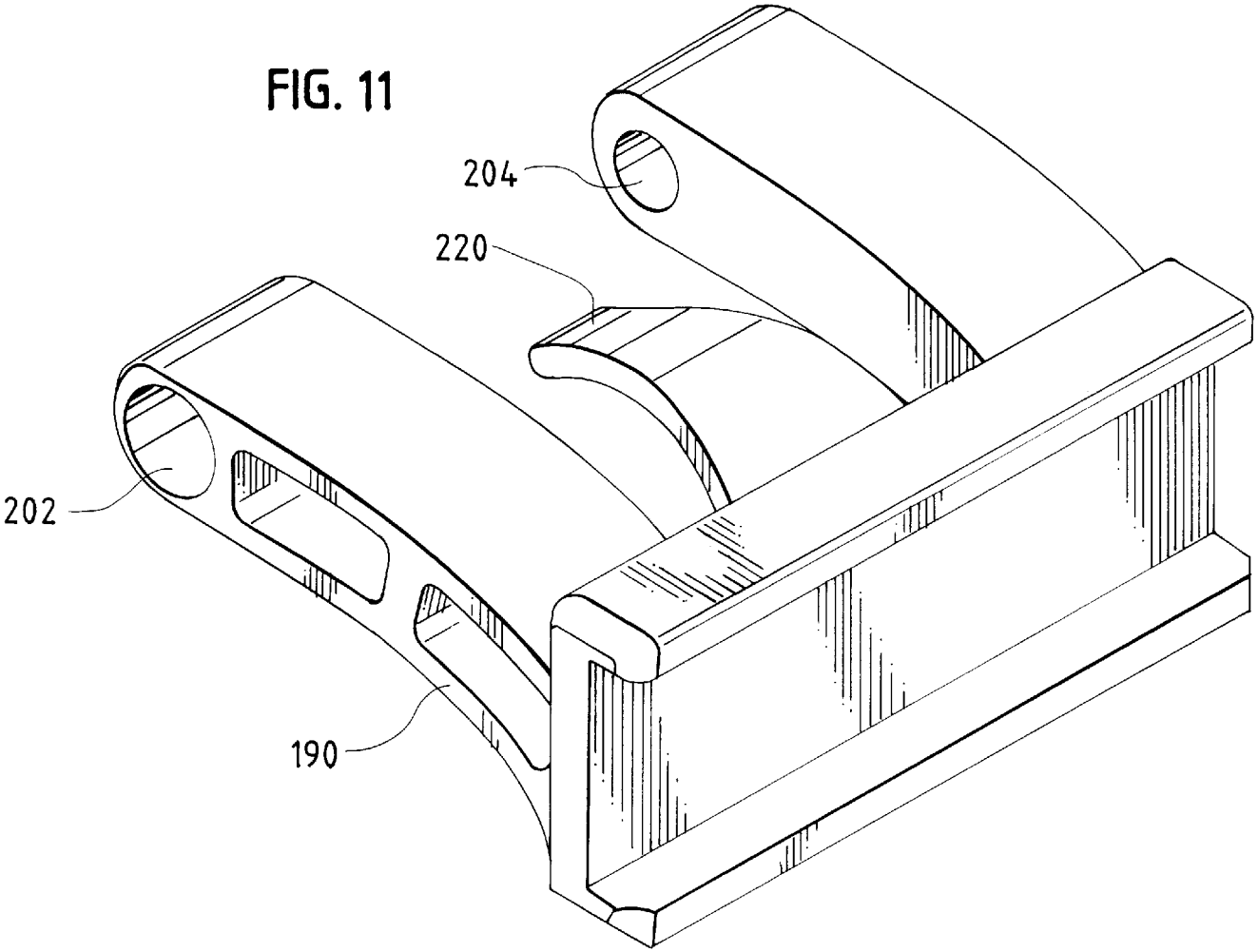
FIG. 11 is a perspective view of the shoe included in the slider shown in FIG. 10.
Figure 12:
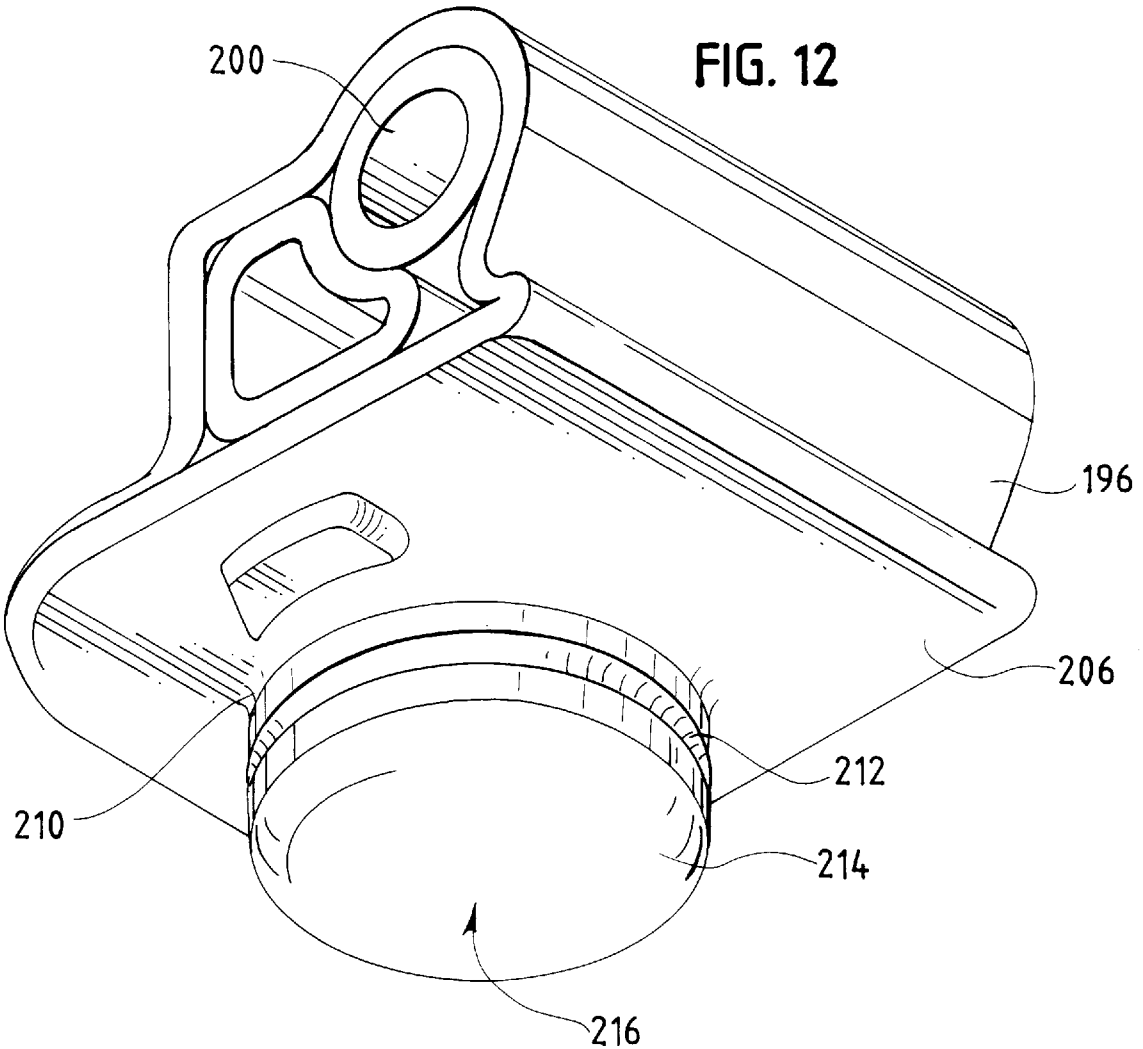
FIG. 12 is a perspective view of the post unit included in the slider shown in FIG. 10.

The slider 188 also includes a downwardly depending post unit 196 (shown in greater detail in FIGS. 10 and 12) which is pivotally mounted to the shoe 190 by a pin 198. The pin 198 is disposed in a passage 200 (FIGS. 10 and 12) in the post unit 196 and passages 202, 204 in the shoe 190 (FIG. 11).

Because the pin 198 is further away from the track 156 than the pin 108 used in the slider 94 described above, the post unit 196 moves closer to the lower edge of the track 156 as the linkage system 136 moves to the extended position, allowing for the slider 188 to be used with sashes which have an outwardly extending lip or surface disposed at the upper edge of the track 156.

The post unit 196 includes a base 206 and a stepped cylindrical extension 208. The cylindrical extension, or post, 208 has a first stepped region, or shoulder, 210 formed adjacent to the base 206. The post 208 tapers to an intermediate neck region 212, terminating in an enlarged cap 214 at the axially outwardmost extending end 216 of the post 208.

The post 208 is maintained in an opening (not shown) of the arm 144 through the use of a clip 218. To that end, the arm 144, the post 208 and the clip 218 cooperate in the same fashion as is described above with respect to arm 54, post 106 and clip 116 in FIGS. 6 and 7, and the clip 218 is substantially similar in structure to the clip 1 16 shown in FIGS. 6 and 7. The clip 218, however, unlike the clip 116, is positioned underneath the arm 144 because the post 208 depends downwardly through the opening in the arm 144.

The post unit 196, and in particular the post 208, is preferably disposed with the axially outwardmost extending end 216 of the post 208 directed outwardly from the slider 188, and hence the track 156 in which the slider 188 is disposed. This orientation of the post 208 assists the operator during installation by disposing the end 216 of the post 208 in a more accessible position.

To maintain the end 216 outwardly oriented from the track 156 in which the slider 188 is disposed, a cantilevered spring arm 220 preferably formed integrally with the shoe 190 contacts the post unit 196. In particular, the spring arm 220 contacts a surface 222 on the base 216 of the post unit 196.

Use of the spring arm 220 may provide some desirable resistance during the attachment of the arm 144 to the slider 188 to maintain the orientation of the post 208. Once the arm 144 has been attached to the post 208, the spring arm 220 preferably provides an insignificant amount of resistance to the pivoting of the post unit 196 relative to the shoe 190.

To limit corrosion to the ends 170, 172 of the arms 144, 146, it is advantageous to limit the amount of metal-to-metal contact between the clips 218, the sliders 186, 188 and the track 156. Therefore, for example, while the track 156, the pin 198, and the arm 144 are made of a metallic material, the shoe 190, post unit 196, and clip 218 are made of a plastic material. With such a configuration, there is no metal to metal contact between components at this area and therefore corrosion is minimized.

It should be recognized that the connector such as shown in FIGS. 9–12, as well as the connector shown in FIGS. 6 and 7, as discussed above could be advantageously used with a wide variety of window operators and window types where a sliding connection to the sash is required.

It should also now be recognized that operators made according to the present invention can be easily and inexpensively manufactured and installed, will operate reliably over a long useful life, and further may be readily used in existing installations.

Further, such window operators may be readily used with a wide variety of installations, as the geometry of the operator linkage is such that a given distance of window opening can be provided by an operator which has a very small lateral dimension when closed. This thus not only allows for narrow windows to have large open distances, but also allows for a single size operator to accommodate a wider variety of window sizes, thereby reducing inventory costs and further reducing handling costs and design and installation errors. This further allows the operator structure to be very compact so as to minimize any visual intrusion which the operator might otherwise have on the window aesthetics.

Still other aspects, objects and advantages of the present invention can be obtained from a study of the specification, the drawings and the appended claims.

What is claimed is:

1. An operator securable to a window frame and window sash generally pivotable relative to the frame about a first edge between open and closed positions, said operator when secured to the frame and sash adapted to control pivotal movement of the sash relative to the frame and comprising:

a first arm having first and second ends, said first arm first end being slidably attachable to a second edge of the window sash opposite a first edge of the window sash about which the window sash is pivotable relative to the frame;

a second arm having first and second ends, said second arm first end being slidably attachable to the second edge of the window sash and being pivotally secured to the first arm;

a base attachable to the frame; and first means attached to the base and to the second ends of the first and second arms for pivoting the first arm relative to the second arm whereby the first ends and the second ends of first and second arms are generally disposed together when attached to the window sash in an open position and the first ends and the second ends are generally spaced apart when attached to the window sash in a closed position, wherein the first means further comprises:

a third arm pivotally secured to the first arm and pivotally secured to the base about an axis;

a fourth arm pivotally secured to the second and third arms; and second means for pivoting the third arm relative to the fourth arm.

2. The operator according to claim 1, wherein the second means comprises:

an input gear rotatably mounted to the base; and a secondary gear pivotally secured to the base about the axis and driveably engaging the input gear and the fourth arm to pivot the fourth arm relative to the third arm.

3. The operator according to claim 1, wherein the second means comprises:

an input gear rotatably mounted to the base;

a sun gear pivotally secured to the base about the axis and driveably engaging the input gear; and a planetary gear secured to the fourth arm and driveably engaging the sun gear.

4. The operator according to claim 3, wherein the input gear is a worm gear.

5. The operator according to claim 1, wherein the second means comprises:

an input gear rotatably mounted to the base;

a sun gear pivotally secured to the base about the axis and driveably engaging the input gear; and a planetary gear integral with the fourth arm and driveably engaging the sun gear.

6. The operator according to claim 1, further comprising:

a track securable to a second edge of a window sash opposite a first edge of the window sash about which the window sash is pivotable relative to a frame; and first and second sliders slidable along the track and pivotally secured to the first and second arms.

7. The operator according to claim 6, wherein:

the first and second arms each have a hole formed in their first ends; and the first and second sliders each further comprise a shoe slidable along the track, and a post pivotally secured to the shoe and disposable through the hole in the first and second arms to secure the first and second arms to the first and second sliders, respectively.

8. The operator according to claim 7, wherein the first and second arms and the track are metallic, and the first and second sliders are plastic.

9. The operator according to claim 8, further comprising first and second plastic clips slidably attached to the first and second arms and cooperating with the posts of the first and second sliders to retain the posts in the holes of the first and second arms.

10. An operator for controlling movement of a window sash generally pivotable relative to a window frame about a first edge between open and closed positions, said operator comprising:

base securable to the window frame;

a first arm pivotable about a first axis on said base;

a second arm pivotally mounted to the first arm about a second axis;

a third arm pivotally attached to the first arm and translatably attachable to a second edge of the window sash opposite a first edge about which the window sash pivots relative to the frame;

a fourth arm pivotally attached to the second arm and the third arm, and translatably attachable to a second edge of the window sash opposite the first edge about which the window sash pivots relative to the frame; and means for driving the second arm about the second axis and the first arm about the first axis to selectively move the window sash when attached to the third and fourth arms between open and closed positions.

11. The operator according to claim 10, wherein the means for driving the second arm about the second axis and the first arm about the first axis comprises:

an input gear rotatably mounted about a third axis; and a gear mounted for rotation about the first axis and driveably engaging the input gear and the second arm.

12. A operator for controlling movement of a window sash generally pivotable relative to a frame about a first edge between open and closed positions, said operator comprising:

a sun gear pivotable about an axis;

a drive gear driveably engaging the sun gear;

a first arm pivotable about the axis;

a second arm pivotally attached to the first arm and driveably engaging the sun gear, a third arm pivotally attached to the first arm and slidably attachable to a second edge of the window sash opposite a first edge about which the window sash pivots relative to the frame; and a fourth arm pivotally attached to the second arm and the third arm and slidably attachable to a second edge of the window sash opposite a first edge about which the window sash pivots relative to a frame.

13. A connector assembly for slidably attaching an arm of a window operator to a window sash, comprising:

a metal track having a C-shaped cross-section and attachable to the window sash;

a plastic shoe translatable along the track and at least partially disposed within the track;

a plastic slider portion including a post, the post being disposable through an opening in the arm of the window operator such that an end of the post protrudes from the opening;

a metal rod extending axially substantially parallel to the track and extending through said shoe and said slider portion to pivotally attach the shoe to the slider portion; and means disposable about the end of the post for securing the arm of the window operator to the connector with the post disposed through an opening in the arm of the window operator.

14. The connector assembly according to claim 13, wherein the track includes a lip which retains the shoe at least partially within the track.

15. The connector assembly according to claim 13, wherein the means disposable about the end of the post for securing the arm of the window operator to the connector with the post disposed through an opening in the arm of the window operator is plastic.

16. The connector assembly according to claim 13, further comprising means for rotationally biasing the plastic post such that axially outwardmost extending end of the post is directed outwardly from the shoe and the track.

17. A connector assembly for slidably attaching an arm of a window operator to a window sash, comprising:

a metal track having a C-shaped cross-section and attachable to the window sash;

a plastic shoe translatable along the track and at least partially disposed within the track;

a plastic post pivotally attached to the shoe about an axis substantially parallel to the track, the post being disposable through an opening in the arm of the window operator such that an end of the post protrudes from the opening; and a plastic clip slidably mountable on the arm of the window operator and disposable about the end of the post for securing the arm of the window operator to the connector assembly with the post disposed through an opening in the arm of the window operator.

18. The connector assembly according to claim 17, wherein the post further includes a cap formed at the end of the post and cooperable with the plastic clip for retaining the post in an opening of the arm of the window operator.

19. A connector assembly for slidably attaching an arm of a window operator to a window sash, comprising:

a metal track attachable to the window sash;

a plastic shoe translatable along the track;

a plastic post pivotally attached to the shoe about an axis substantially parallel to the track, the post including a first proximal surface and being disposable through an opening in the arm of the window operator such that an end of the post protrudes from the opening;

means disposable about the end of the post for securing the arm of the window operator to the connector with the post disposed through an opening in the arm of the window operator; and means for rotationally biasing the plastic post such that an axially outwardmost extending end of the post is directed outwardly from the shoe and the track, said means for rotationally biasing the plastic post including a spring attached to the shoe, said spring contacting the first proximal surface of the post such that the axially outwardmost extending end of the post is directed outwardly from the shoe and the track.

20. The connector assembly according to claim 19, wherein the spring is a cantilever spring formed integrally with the shoe.

21. An operator for controlling movement of a window sash relative to a frame, said window sash being pivotable relative to an axis, said operator comprising:

a drive mechanism securable to the window frame, said mechanism controllably moving a first drive arm having an opening at one end thereof;

a metal track having a C-shaped cross-section and attachable to the window sash;

a plastic shoe translatable along the track and at least partially disposed within the track;

a plastic slider portion including a post, the post being disposable through said arm opening with an end of the post protruding from the opening;

a metal rod extending axially substantially parallel to the track and extending through said shoe and said slider portion to pivotally attach the shoe to the slider portion; and means disposable about the end of the post for securing the operator first drive arm to the post.

22. The operator according to claim 21, wherein the track includes a lip which retains the shoe at least partially within the track.

23. The operator according to claim 21, wherein the securing means is plastic.

24. The operator according to claim 21, further comprising means for rotationally biasing the plastic post such that an axially outwardmost extending end of the post is directed outwardly from the shoe and the track.

25. An operator for controlling movement of a window sash relative to a window frame, said window sash being pivotable relative to an axis, said operator comprising:

a drive mechanism securable to the window frame, said mechanism controllably moving a first drive arm having an opening at one end thereof;

a metal track having a C-shaped cross-section and attachable to the window sash;

a plastic shoe translatable along the track and at least partially disposed within the track;

a plastic post pivotally attached to the shoe about an axis substantially parallel to the track, the post being disposable through said arm opening with an end of the post protruding from the opening; and a plastic clip slidably mounted on the first drive arm and disposable about the end of the post for securing the operator first drive arm to the post.

26. The operator according to claim 25, wherein the post further includes a cap formed at the end of the post and cooperable with the plastic clip for retaining the post in the first drive arm opening.

27. An operator for controlling movement of a window sash relative to a frame, said window sash being pivotable relative to an axis, said operator comprising:

a drive mechanism securable to the window frame, said mechanism controllably moving a first drive arm having an opening at one end thereof;

a metal track attachable to the window sash;

a plastic shoe translatable along the track;

a plastic post pivotally attached to the shoe about an axis substantially parallel to the track, the post including a first proximal surface and being disposable through said arm opening with an end of the post protruding from the opening;

means disposable about the end of the post for securing the operator first drive arm to the post; and means for rotationally biasing the plastic post such that an axially outwardmost extending end of the post is directed outwardly from the shoe and the track, said means for rotationally biasing the plastic post including a spring attached to the shoe, said spring contacting the first proximal surface of the post such that the axially outwardmost extending end of the post is directed outwardly from the shoe and the track.

28. The operator according to claim 27, wherein the spring is a cantilever spring formed integrally with the shoe.

* * * * *